United States Patent [19]

Cantera

[11] 4,057,903

[45] Nov. 15, 1977

[54] GUIDE LINE HOLDER

[76] Inventor: Pasquale Cantera, 11 White Ave., Newton Center, Mass. 02159

[21] Appl. No.: 694,962

[22] Filed: June 11, 1976

[51] Int. Cl.[2] ..... B43L 7/00

[52] U.S. Cl. ..... 33/86; 33/339

[58] Field of Search ..... 33/85, 86, 339

[56] References Cited

U.S. PATENT DOCUMENTS

| | | | |
|---|---|---|---|
| 1,004,194 | 9/1911 | Platt | 33/85 |
| 1,502,046 | 7/1924 | Mann | 33/85 |
| 1,643,880 | 9/1927 | Elder | 33/339 |
| 2,286,669 | 6/1942 | Carr | 33/86 |
| 2,615,253 | 10/1952 | Weathers | 33/85 |
| 2,833,043 | 5/1958 | Patejdl | 33/85 |

*Primary Examiner*—Charles E. Phillips
*Attorney, Agent, or Firm*—Kenway & Jenney

[57] ABSTRACT

Disclosed is a bracket for supporting a mason's guide line in place adjacent an existing courses of bricks that form intersecting walls. The bracket includes a base portion defining planar inner surfaces for engaging a pair of wall faces adjacent a corner and a retaining line, of adjustable length, secured to the base and including a spring portion. The retaining line is suitable for engaging a fixed structure (e.g., a similar line of another bracket) remote from the corner to retain the bracket in place through friction resulting from the essentially horizontal force applied to the base by the retaining line. The base also includes a pair of position indicators for determining the orientation of the planar inner faces of the bracket with respect to the vertical. A guide line support is secured to the base and projects therefrom in a direction parallel to the line of intersection of the two planes defined by the base. A pair of such brackets can be supported on opposite corners of a wall with a mason's guide line extending between the guide line supports of the two brackets.

9 Claims, 2 Drawing Figures

GUIDE LINE HOLDER

BACKGROUND OF THE INVENTION

The present invention relates to a guide line holder, and more particularly, to such a holder suitable for holding a guide line such as is used in the laying of courses of brick.

As labor and material costs continue to rise, the expense of brick construction has increased to the point where architects and builders often seek alternative construction designs and materials. Naturally, a major factor in determining the cost of brick construction is the number of bricks a mason can lay per day in a skillful manner and without undue strain. Certain aspects of brick laying contribute heavily to the total time investment in erecting a given brickwork construction. Typically, a brickwork construction proceeds with the preparation of "leaders", consisting of a few bricks on two or more levels, above the last full course of bricks that have been laid. The leaders are constructed at the corners of a brickwork construction, and then the courses of brick intermediate the corners are filled in. The preparation of such "leaders", which must be both plumb and level, typically requires a substantial amount of time. Furthermore, with a large-scale project in which a number of masons work as a team, the masons who typically work filling in the level courses of brick between leaders often are periodically idle while additional leaders are being prepared.

Although, guide line holders have been proposed in the past, some proposed holders have required repositioning for the laying of each course of bricks; others, with varying degrees of success, have attempted to permit the laying of multiple courses of bricks with a single positioning of the guide line holder. Each proposal of the latter variety, however, has suffered from one or more various drawbacks. Thus, for example, the various guide line holders had included portions projecting into the brick walls to provide support for the holder and/or proper positioning of the holder. Such constructions, however, cause disruption of the mortar when the holder is withdrawn from the wall either after completion of the wall, or for movement to a higher position after a number of courses of brick have been laid. Additionally, such repositioning of the holder is inhibited because of the difficulty of the removal of the holder from the wall. Some of the previous proposals have included structure for contacting existing courses of brick over a substantial vertical extent (e.g., the holders of the above-mentioned Platt patents engage nine existing courses of brick), thereby limiting their usefulness in the building of a low structures, and rendering the holders difficult to reposition where scaffolding has been placed adjacent the wall under construction. A further feature of certain prior holders that has prevented them from gaining acceptance in the trade has been the interference with the work of the mason by structure of the holder above the existing courses of brick.

OBJECT AND SUMMARY OF THE INVENTION

In view of the above discussion, it is a principal object of the present invention to provide a guide line holder that overcomes the various drawbacks of previous proposals.

More particularly, it is an object of the present invention to provide a guide line holder that does not disturb the existing brickwork, that is easy to move to a new position when required, and that is of a simple construction permitting inexpensive manufacture and easy usage.

To achieve the foregoing and other objects as shall further appear hereinafter, according to the present invention a bracket for supporting a mason's guide line comprises a base for engaging a corner of existing courses of brick of a brickwork structure and a guide line support secured to the base and projecting therefrom for supporting a guide line above the uppermost existing course of bricks. The base includes structure defining an inside corner for engaging the outside corner of intersecting walls, with that structure defining first and second planes for planar contact with only exposed vertical surfaces of the walls. Position indicator means are provided for indicating the orientation of those planes with respect to the vertical and a retaining line is secured to the base for retaining the base against the wall faces. The retaining line extends between the base and a spring disposed to be secured under tension at a location remote from the base, with the retaining line being substantially parallel to one of the intersecting walls with which the bracket is used. Means are also provided for altering the length of the retaining line between the base and the spring, in order to facilitate use of the bracket at virtually any jobsite.

In preferred embodiments of the invention, the bracket as described above includes first and second bubble levels for indicating the positions of said first and second planes; guide line snubbing means are provided on the base for snubbing a taut guide line that is engaged with the guide line support means; the bracket further includes adjustable means for engaging the faces of the intersecting walls to adjust the orientation of the first and second planes of the bracket in order to align those planes with the vertical; and the bracket further includes a guide line holder slide that is slidably supported on said guide line support, thereby enabling a guide line to be moved to accomodate a plurality of courses of brick without the necessity of moving the entire bracket.

BRIEF DESCRIPTION OF THE DRAWINGS

Other objects, features, and advantages of the invention will appear from the following description of particular preferred embodiments, taken together with the accompanying drawing in which.

DETAILED DESCRIPTION OF PARTICULAR PREFERRED EMBODIMENTS

Figures 1, 2:
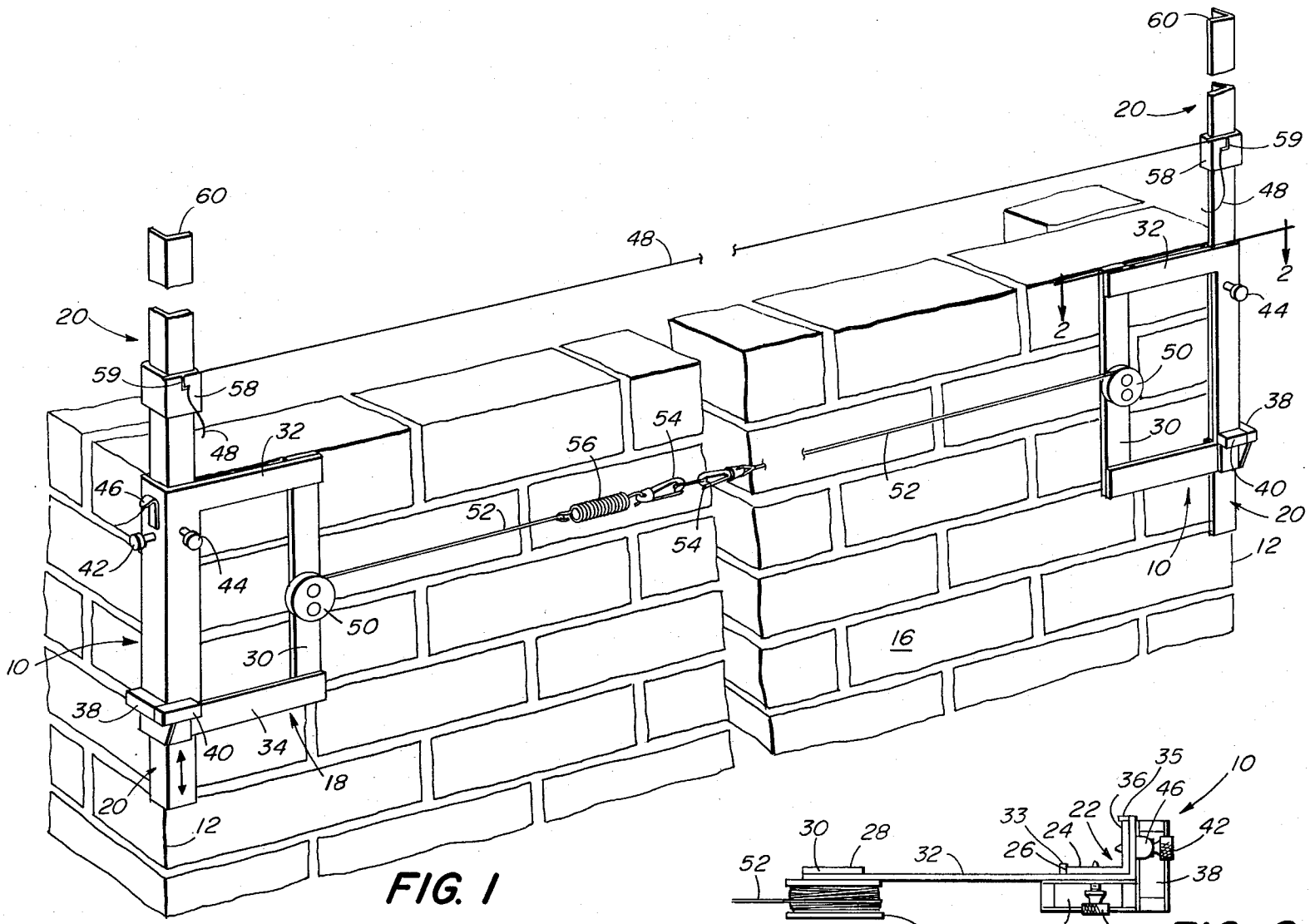
FIG. 1 is a perspective view of a pair of brackets constructed in accordance with the present invention and being employed to support a guide line adjacent an existing partially completed brickwork construction.
FIG. 2 is a view taken at 2—2 of FIG. 1.

Referring to the drawings, there is shown a pair of brackets 10 supported at corners 12 and 14 of an existing, partially-completed brickwork structure 16. Each bracket includes a base 18 for engaging existing courses of brick and an integral guide line support 20 projecting upwardly from the base at the respective corner (i.e., 12 or 14). The base can be formed from sheet metal to define an inside corner 22 (see FIG. 2) for engagement with the respective outside corner 12 or 14 of the existing brickwork structure. The base includes structure defining a pair of planes, which intersect in a right angle at the inside corner 22, the planes being arranged for contact with exterior faces of the two brickwork wall segments that meet at the respective corner.

Referring to FIG. 2, a first plane is defined by inside face 28 of member 30, which is vertically disposed and which can be spaced apart from the corner 22 by a distance of several inches, and by a vertical strip 33 disposed adjacent an angle member 26 that is lower portion of the support 20. The member 33 preferably projects slightly beyond an inside surface 24 of angle member 26 thereby permitting member 26 to freely slide relative to the bricks. Horizontal connecting members 32, 34 extend between the strip 33 and the member 30. A strip 35 adjacent the other inside surface 36 of the angle member 26 defines the second planar surface for engagement with the second wall segment defining one of the corners of the brickwork structure. As is evident from FIG. 1, in the preferred form illustrated, the base 10 has a vertical extent equal to about three courses of standard brick.

A pair of bubble level indicators 38, 40 are mounted adjacent the exterior corner of the base parallel to the planes defined by surfaces 24 and 36. Adjustment means in the form of a pair of screws 42, 44 are supported in threaded openings in the base. Slots (not visible in the drawing) can be provided in the angle member 26 to accommodate the screws. Each screw is aligned with, and vertically spaced from, one of the level indicators 38, 40. Also supported on the exterior of the base 10, adjacent its outside corner, is a hook-shaped snubber 46 which can be used to secure the end of a guide line 48, as further discussed below. (Alternatively, snubber 46 could be mounted on an exposed portion of member 26.) A fixed reel 50 is secured to the outer surface of the vertical member 30 and serves as a storage means, and as an anchor point, for an adjustable length retaining line 52. The retaining line is secured to the reel 50 and is stored by being wound around the reel.

In the use of the brackets, as indicated in FIG. 1, enough of the line 52 is unwound from the reel 50 to permit a hook 54, or similar structure, at the free end of the line to be secured to some fixed object for retaining the bracket 10 in place on the brickwork without the necessity of structure of the bracket penetrating the brickwork. In the illustrated embodiment, a biasing means (e.g. spring 56) is provided adjacent the hook 54 and the lines 52 from each bracket are unwound until the hooks 54 can be engaged with each other with each of the springs 56 under tension. This arrangement serves to resiliently support each of the brackets 10 in place on the brickwork, while permitting the convenient removal and/or vertical adjustment of the brackets. A bracket 10 also could be retained at a corner by securing the hook 54 to an existing fixed feature of the partially completed structure (e.g., a window or door frame).

In the preferred embodiment illustrated, each guide line support 20 has a slide member 58 slidably mounted thereon. The support of the guide line 48 in a notch 59 of the slide 58 permits vertical adjustment of the guide line 48 by simply releasing each end of the line from the snubbers 46, raising the slides 58 to appropriate positions, and re-snubbing the guide line about the snubbers 46. It has been found that no retaining means are required for the slide 58 since the tension in the line 48 is sufficient to maintain the slide at any vertical position against the influence of gravity.

A simple and convenient bracket could be fashioned with the guide line 48 being simply drawn over a groove 60 cut in an upper edge of the guide line support 20 and then snubbed around the snubber 46. With the member 26 slidable with respect to the base 18 and the bricks, substantially vertically adjustment of the guide line 48 would be possible before movement of the bases 18 is necessary.

As will be evident to those skilled in the art, with the structure as described, the guide line brackets 10 can be easily and rapidly installed in place on existing courses of brick without the necessity of bracket portions penetrating the faces of those courses of brick, and thereby disturbing the structure and complicating removal of the brackets. The brackets are retained in place by tension in springs 56 and the adjustable retaining lines 52 permit the usage of the brackets with structures of virtually any design and dimension. Since each guide line supports 20 is supported at the exact corners of the existing structure and is co-planar with the planes of the base 10 that contact the faces of the existing walls, the supports 20 can be rendered plumb by simply leveling the bracket, using the level devices 38 and 40 and adjustment screws 42 and 44. Naturally, shims or other arrangements could replace the adjustment screws 42 and 44, but the latter are preferred for convenience and precision.

With the brackets thus in place adjacent the uppermost course of brick of an existing, partially-completed structure, the guide line 48 is engaged with the slides 58, or with grooves 60 and snubbers 46. The slides, or grooves, are then positioned an appropriate distance above the uppermost course of bricks with the guide line level. As will be understood by those skilled in the art, the guide line 48 is thus placed to guide the laying of another course of brick on top of the existing uppermost course of brick, without the necessity of building "leaders" at the corners, each brick of which must be individually rendered both plumb and level. After the course of the brick has been laid, the guide line 48 may be vertically adjusted, as discussed above, to serve as a guide for the next course of brick. Eventually, the slide 58 will reach the top of the guide line support 20, or the member 26 will reach its uppermost position relative to the base, requiring that the bases 18 be moved upwardly to permit further courses of brick to be laid. Because the brackets do not penetrate the face of the brick work, and because of their limited vertical extent, the brackets may be raised along the corners 12 and 14 manually until the upper edges of the bases 18 are substantially aligned with the new uppermost course of brick.

As will also be apparent to those skilled in the art, the provision of a guide line support 20 disposed precisely at the corners 12 and 14 and not including structure projecting along the faces of the walls defining those corners permits easy access for the mason to lay new bricks without having to "work around" cumbersome support structure extending along the length of the course of bricks to be laid.

While particular preferred embodiments of the present invention has been illustrated in the accompanying drawings and described in detail herein, other embodiments are within the scope of the invention and the following claims.

What is claimed is:

1. A bracket for supporting a mason's guide line comprising:

a guide line, a base including structure defining an inside corner for engaging the outside corner of intersecting walls, said structure defining first and second planes for planar contact with only exposed vertical faces of said walls, first and second position indicator means for indicating the orientation of said first and second planes with respect to the vertical, adjustable means on said base for engaging said wall faces to adjust the orientation of said first and second planes with respect to the vertical;

a retaining line for retaining said base against said wall faces, said retaining line extending from substantially the vertical midpoint of said base and including hook means securable at a location remote for said base, said retaining line including biasing means for tensioning the line, means for altering the length of said retaining line comprising a reel for storing retaining line on said base, a guide line support secured to said base and projecting therefrom parallel to the line of intersection of said first and second planes, and comprising means for engaging said line which means are slidable relative to said base in a direction parallel to said line of intersection.

2. The bracket of claim 1 wherein said first and second position indicator means are bubble levels.

3. The bracket of claim 1 further including guide line snubbing means secured to said base for snubbing a taut guide line that is engaged with said guide line support means.

4. The bracket of claim 1 for use with walls formed from brick having a predetermined vertical thickness, said base having a vertical length equal to about three times said predetermined vertical thickness.

5. The bracket of claim 4 wherein said guide line support has a vertical length equal to at least three times said predetermined vertical thickness.

6. The bracket of claim 5 further including a guide line holder slidable mounted on said guide line support.

7. The bracket of claim 1 wherein said guide line support is slidable relative to said base in a direction parallel to said first and second planes.

8. The bracket of claim 7 wherein said guide line support slides in a vertical channel defined by spaced apart vertical strips on said base.

9. The bracket of claim 1 wherein said biasing means comprise an extension spring adjacent the free end of said retaining line.

* * * * *